US010279383B2

(12) United States Patent
Ruffner et al.

(10) Patent No.: US 10,279,383 B2
(45) Date of Patent: May 7, 2019

(54) APPARATUSES AND METHODS FOR POLISHING A METAL SHEET OR PLATE LEVELER

(71) Applicant: SSAB Enterprises, LLC, Lisle, IL (US)

(72) Inventors: Paul Raymond Ruffner, Eldridge, IA (US); Susan Marie Tucker, Moline, IL (US); Anthony Edward Wellington, Conesville, IA (US); Thomas Jacob Cox, Bettendorf, IA (US)

(73) Assignee: SSAB Enterprises, LLC, Lisle, IL (US)

( * ) Notice: Subject to any disclaimer, the term of this patent is extended or adjusted under 35 U.S.C. 154(b) by 0 days.

(21) Appl. No.: 15/339,408

(22) Filed: Oct. 31, 2016

(65) Prior Publication Data

US 2018/0117652 A1 May 3, 2018

(51) Int. Cl.

| | |
|---|---|
| ***B24B 5/37*** | (2006.01) |
| ***B21B 28/04*** | (2006.01) |
| ***B21B 15/00*** | (2006.01) |

(52) U.S. Cl.

CPC ..... *B21B 28/04* (2013.01); *B21B 15/00* (2013.01); *B21B 2015/0071* (2013.01)

(58) Field of Classification Search

CPC ..... B24B 5/37
USPC ..... 451/49, 424, 426, 428, 439, 348, 312, 451/319

See application file for complete search history.

(56) References Cited

U.S. PATENT DOCUMENTS

| | | | | |
|---|---|---|---|---|
| 675,590 | A | 6/1901 | Darrall | |
| 1,212,131 | A * | 1/1917 | Coate | B24B 5/363 451/426 |
| 2,461,459 | A | 2/1949 | Wilkes | |
| 2,651,152 | A | 9/1953 | Schnuck | |
| 4,841,675 | A * | 6/1989 | Perneczky | B24B 5/37 451/173 |
| 5,255,549 | A | 10/1993 | Williams | |
| 5,383,306 | A * | 1/1995 | Michalon | B21B 28/04 451/106 |
| 6,283,823 | B1 * | 9/2001 | Mori | B21B 28/04 451/424 |
| 7,465,374 | B2 * | 12/2008 | Porco | D21G 3/00 15/256.51 |
| 7,637,133 | B2 | 12/2009 | Buta | |

(Continued)

FOREIGN PATENT DOCUMENTS

| | | |
|---|---|---|
| CN | 103464965 | 12/2015 |
| CN | 205183384 | 4/2016 |
| DE | 29604532 U1 | 4/1996 |

(Continued)

OTHER PUBLICATIONS

International Searching Authority, Search Report and Written Opinion re PCT/US2017/59359, dated Jan. 25, 2018, 13 pgs.

*Primary Examiner* — Robert Rose
(74) *Attorney, Agent, or Firm* — Greenberg Traurig, LLP

(57) ABSTRACT

An apparatus and method for safely and efficiently polishing the work rolls of a metal sheet or plate leveler. The apparatus includes a support and one or more polisher assemblies to be inserted between the upper and lower work rolls of the leveler, for simultaneously polishing the upper and/or lower work rolls of the leveler during the rotation of the work rolls.

40 Claims, 7 Drawing Sheets

(56) References Cited

U.S. PATENT DOCUMENTS

| | | | |
|---|---|---|---|
| 2005/0039288 | A1 | 2/2005 | Pisacane |
| 2013/0192325 | A1 | 8/2013 | Porco |

FOREIGN PATENT DOCUMENTS

| | | | |
|---|---|---|---|
| GB | 442483 | A | 2/1936 |
| JP | 200605193 | | 8/2006 |

* cited by examiner

APPARATUSES AND METHODS FOR POLISHING A METAL SHEET OR PLATE LEVELER

FIELD OF INVENTION

This disclosure relates generally to metal sheet or plate leveler polishers, and more specifically relates to apparatuses and methods for polishing the work rolls of a leveler.

BACKGROUND OF THE INVENTION

Levelers, such as hot levelers, are commonly used in metal sheet and plate mills, namely hot rolling mills for producing metal sheets or plates. FIG. 1 illustrates a typical leveler 100 from the operator side. As shown in FIG. 1, the leveler usually includes moveable upper work rolls 60 and stationary lower work rolls 62. The metal sheet or plate enters the leveler from entry side 64 of the leveler, passes between the upper and lower working rolls, and then leaves the leveler through exit side 66. The rolling and cooling processes of the leveler reduce remaining flatness errors and residual stresses of the metal sheets or plates passing therethrough. However, as a result of passing metal sheets or plates through the rollers, under substantial compressive forces on the metal sheets or plates, particles tend to collect on the work rolls working the metal sheets or plates, which could cause gouges, pits, and scratches of the sheet and degradation in the quality of subsequently leveled plates. Thus, the polishing and cleaning of the work rolls is crucial for the effectiveness and quality of the metal sheets or plates passing through the levelers.

Conventionally, a leveler is polished by bracing the leveler in an open position, in which top portion 42 of the leveler is raised (e.g., with a roll nest support car). An operator would physically crawl into the open leveler and use a hand grinder power tool to grind-polish the work rolls. This process is potentially dangerous and inefficient, as operators could possibly be injured while polishing the work rolls. Likewise, the extent to which the work rolls are consistently and qualitatively cleaned varies from operator to operator, or upon the mechanical condition of the grinding equipment, as well as whether or not a region on the work rolls is completely accessible to the operator attempting to polish the work rolls. Uniformity in the polishing operation can vary not only relative to the accessibility of the work roll region, it can vary as a function of the amount of time and pressure invested by the operator. The lack of uniformity can affect the resulting condition of the work rolls, and, in turn, the quality of the leveled metal sheet or plate.

More automated approaches have been utilized. One such technique, disclosed in Chinese Pat. No. CN205183384 calls for the use of a concave-shaped steel-bristle brush for cleaning a work roll.

Alternatively, Japanese Pat. No. JP200605193 discloses the use of a cleaning member that includes an inflatable air bladder that reciprocates along the length of a work roll, while the work rolls are rotated, to clean them.

The present invention has as its objectives, the goal of efficiently, effectively and safely cleaning the work rolls to ensure the quality of the metal sheets or plates being processed by the leveler itself.

These and other objectives and advantages will become apparent in view of the following disclosure, including the drawings and claims.

SUMMARY OF THE INVENTION

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

One aspect of the present invention is directed to an apparatus for polishing the work rolls of a metal sheet or plate leveler where each work roll has a work roll circumference, as well as a work roll length, determined along its longitudinal axis. The leveler includes a frame, a series of upper work rolls and a series of lower work rolls. In one embodiment, the polishing apparatus includes upper and lower polishing platforms, one platform containing the polishers for polishing the upper work rolls and the other lower platform containing the polishers for polishing the lower work rolls of the leveler. The upper work rolls of the leveler are arranged in a first series and the lower work rolls of the leveler are arranged as a second series. In another embodiment, as described hereinbelow, the polishing apparatus utilizes a single platform with polishers that are fixed in position, as integrated onto each side of the platform.

The polishing unit comprises at least one polisher configured for engaging and polishing at least one of the work rolls from the series of upper and lower work rolls in the leveler, when that respective work roll is rotated. In that embodiment, the polisher is configured to engage and polish at least the substantial entire length of that one or more work roll of the leveler, as the work roll is rotated. Further, the at least one polisher comprises a substantially rigid concave pan having an abrasive material positioned therewithin for exposure of the abrasive material to the respective work roll, upon engagement of the polisher with the work roll and further, upon rotation of the work roll within the substantially rigid concave pan.

In some embodiments of the invention the at least one polishing unit comprises at least two polishers, a first polisher configured to engage at least one work roll in the upper series of work rolls, and a second polisher configured for engaging at least one work roll in the lower series of work rolls. In these embodiments, the first and second polishers are configured to polish the respective upper and lower work rolls simultaneously as the respective work rolls rotate simultaneously, while in engagement with the abrasive material within each of the first and second polishers.

In some preferred embodiments of the invention, the at least one polishing unit comprises a first series of upper polishers corresponding in number to the number of work rolls in the series of upper work rolls, together with a second series of lower polishers corresponding in number to the number of work rolls in the series of lower work rolls. In these embodiments, the first series of polishers are configured to simultaneously engage and/or polish each of the work rolls in the series of upper work rolls respectively, while the second series of polishers are configured to simultaneously engage each of the work rolls in the series of lower work rolls respectively. In these embodiments further, all of the first and second series of polishers are operably configured to polish the respective series of upper and lower work rolls as all of the work rolls simultaneously rotate, while engaged with the respective ones of the first and second series of polishers.

In some versions of the invention, all of the series of upper polishers are operably positioned on the upper platform, and all of the series of lower polishers are operably positioned on the lower platform, with the polishers on the upper platform being exposed for polishing the lower circumferential surfaces of the series of upper work rolls and the polishers in the lower platform being exposed for polishing the upper circumferential surfaces of the series of lower work rolls.

In some embodiments of the invention, the upper and lower platforms bearing the upper and lower series of polishers are separable from one another, while in other embodiments the upper and lower platforms are integrated into a single platform with an upper surface bearing the upper polishers and a lower surface bearing the lower polishers. In those embodiments in which the upper and lower platforms, together with the first and second series of polishers respectively are selectively movable relative to each other, the upper and lower platforms are capable of being repositionable; from an orientation position in which the upper and lower platforms are substantially adjacent each other to permit both the alternative introduction and retraction of the apparatus into and from a position within the open leveler, between the respective series of upper and lower work rolls—to a polishing position in which the upper and lower platforms are extended to reposition the first and second series of polishers respectively into an operable engagement with respective ones of the series of upper and lower work rolls, to enable the polishing of the work rolls upon their simultaneous rotation, while the leveler is in its open position.

In yet other embodiments, the upper and lower platforms, together with the first and second series of polishers respectively, are restrainably fixed relative to each other where each of the series of polishers are positioned upon the top and bottom of a single integrated platform. In this embodiment, the upper work rolls of the leveler engage with the respective series of upper polishers upon movement of the top of the leveler, together with its series of upper work rolls downwardly, toward the series of upper polishers, to establish contact between the lower circumferential portions of the upper work rolls and the abrasive material within each of the concave pans comprising the upper polishers on the upper surface of the platform. Likewise, in these embodiments, each of the series of lower polishers on the bottom surface of the one platform is configured for engagement with respective ones of the series of lower work rolls, upon the continued spring-loaded movement of the platform downwardly—as a result of the continued downward movement of the top of the leveler to prompt its lower polishers towards contact with the series of lower work rolls in the bottom portion of the leveler. This downward movement will establish contact between the upper circumferential positions of the lower work rolls and the abrasive material within each of the concave pans positioned within the lower polishers on the integrated platform. In these embodiments the apparatus utilizes all of the work rolls in the series of upper work rolls to be configured to be brought into operational engagement with the polishers in the upper platform initially, while all of the work rolls in the series of lower work rolls are subsequently engaged upon the spring-loaded movement of the platform, as the top of the leveler continues to be lowered. The polishing of the work rolls in both the upper and lower series of work rolls may take place simultaneously after engagement has been achieved through the lowering of the top of the leveler, upon the rotation, and polishing of all of the work rolls. Through the structure and operation of this embodiment, all of the work rolls in both series of the upper and lower work rolls can be polished simultaneously.

In these preferred embodiments, regardless of whether the positions of the upper and lower platforms are repositionable relative to each other or are restrainably fixed in position to each other, the series of upper work rolls, as well as the series of lower work rolls are contemplated as being capable of being withdrawn from each other to enable the "opening" of the leveler, and for insertion of the polishing apparatus into position and alignment with the respective polishers and work rolls, as well as out of the polishing positions aligned with the upper and lower work rolls, upon completion of the polishing operation. The upper work rolls can then be raised and lowered at will to reposition the work rolls themselves for use in their capacity of metal sheet or plate leveling.

In some preferred embodiments of the invention, the substantially rigid concave pan comprises a substantially rigid, metallic pan assembly in which the abrasive material comprises a substantially abrasive surface positioned within the substantially rigid concave pan as a lining, for positioning, alignment and engagement with the respective one of the work rolls. In these embodiments, the abrasive surface of the lining comprises an abrasive paper or other material substrate capable of bearing the exposed abrasive surface while providing a layer of firm rubber backing behind the abrasive surface. Further, in these embodiments, the substantially rigid concave pans and abrasive materials positioned therewithin are configured for alignment and engagement with the work rolls, and to further conform to the circumferential shape of the exposed portion of the work roll to equivalently distribute the exposure and engaged pressure of the abrasive material to the exposed circumferential portion of the respective work rolls upon which the polishers are engaged, and serve to polish upon rotation of the respective work rolls. Further, as there remains a degree of flexibility in the concave pans in some embodiments, the pans will possess a degree of flex to "self-adjust" about the circumference of the work roll to more fully, favorably and efficiently expose the work rolls, upon engagement with the polishers, to a consistent degree of pressured engagement and polishing efficiency with the abrasive material positioned within the concave pans. In many of these preferred embodiments, the first and second series of polishers positioned within the first and second platforms are configured to most efficiently, simultaneously polish the series of upper work rolls and the series of lower work rolls respectively to further enhance the efficiency of the apparatus over the use of single polisher elements—well beyond the efficiency and potential safety exposure of an individual laborer attempting to polish the work rolls manually with portable handheld power equipment.

In the embodiments of the invention in which the upper and lower platforms are repositionable relative to each other between their orientation and polishing positions, a platform translation element is positionable therebetween the upper and lower platforms which enables each of the upper and lower platforms to be extended and retracted relative to each other. In its retracted orientation position, the apparatus can be alternatively positioned for entry into the open leveler, as well as removed from the open leveler. In its extended position the upper series of polishers can be extended into engagement and polishing contact with the series of upper work rolls and, likewise, the lower platform with its lower series of polishers can be extended downwardly into their polishing position with regard to the series of lower work rolls. In at least some of these embodiments, the platform translation element comprises an air bag assembly positioned between the upper and lower platforms of the apparatus through which an air motor with valve member controls can alternatively inflate and deflate the air bag assembly to, in turn, extend and retract the positions of the upper and lower platforms respectively. In yet other such embodiments, the translation element comprises an electric motor assembly positioned between the upper and lower platforms of the apparatus, with suitable controls, to extend and retract each of the platforms relative to the other, between their orientation and polishing positions, such as through the use of a threaded drive.

In some embodiments of the invention, when the upper and lower platforms are extended to enable the simultaneous polishing of the upper work rolls and lower work rolls by the upper and lower polishers respectively, polishing occurs upon rotation of the work rolls, while engaged with the abrasive material in the polisher. In these embodiments also, after polishing, the upper and lower platforms may be retracted to enable the simultaneous reorientation of the platforms to enable repositioning of the apparatus, or at least its polishing unit, into and out of the leveler at a location between the upper and lower work rolls. Further, in these embodiments, the invention contemplates the use of locking pins for locating and locking the apparatus into its operable position within the frame of the leveler, in which the respective concave pans are aligned with the respective work rolls for engagement, polishing and disengagement. Further, in at least some of these embodiments, a closing element is utilized for locking the upper and lower platforms relative to each other in their orientation position for entry and withdrawal of the apparatus, while the apparatus is not in its polishing position. In some of these embodiments, the closing element comprises an assembly of rollers and levers.

In some of the embodiments of the invention, each of the upper and lower platform(s) cooperates with an apparatus table support, with the polishing unit containing the platform or platforms reciprocating in and out of the leveler for orientation, relative to the table support. Further, in some of the embodiments of the invention the apparatus includes a motorized assembly for removably inserting and retracting the apparatus platform or platforms (depending on the embodiment) from its/their position between respective aligned ones of the upper and lower work rolls. Regardless of whether the translation element comprises an air bag system or an electric motor, appropriate controls and switching mechanisms are contemplated in the embodiments to enable the use of the translation element—where the upper and lower platforms are separable from one another and respectively extend towards and/or retract from the aligned work rolls with which they will be exposing the abrasive materials during rotation of those work rolls. Likewise, the motorized assembly for removably inserting the apparatus between the upper and lower work rolls includes an insertion control assembly.

The invention also includes several embodiments of methods associated with the utilization of the polishing apparatus to polish the upper and lower work rolls of a metal sheet or plate leveler. In some of the embodiments of the inventive method, the method includes the steps of configuring the leveler into its open polishing position to accept the insertion and/or removal of the polishing apparatus; configuring the polishing apparatus into an orientation position to enable insertion of the apparatus into the leveler; inserting the polishing unit of the apparatus into the leveler wherein the polishing unit includes polishers configured from substantially rigid concave pans which can be simultaneously aligned for engagement with respective work rolls, to polish respective ones of the upper and lower work rolls of the leveler during the rotation of the work rolls. With this method, at least one of the polishers is configured to engage and polish substantially the entire operable length (along the longitudinal axis) of the corresponding work roll of the leveler. In these embodiments also, the steps further include extending the upper and lower polishers to engage the upper and lower work rolls of the leveler, followed by the rotation of the work rolls to enable polishing, as well as the step of simultaneously polishing all of the contacted work rolls during the rotation of those work rolls. In at least some of these embodiments also, the substantially rigid concave pans include an abrasive material, and a resilient lining between the pan and the abrasive material, for enabling the polishing of the work rolls during their rotation.

In yet other embodiments the method for polishing the work rolls of the leveler through the use of a polishing apparatus comprises the steps of: configuring the leveler in an open position; inserting the polishing unit into the leveler device wherein the polishing apparatus includes polishers on its top and bottom surfaces for simultaneously engaging and polishing the respective work rolls of the leveler during the rotation of the work rolls. In these embodiments of the method, at least one of the polishers includes a substantially rigid concave pan having an abrasive material therewithin, the pan being configured to engage and polish at least the majority of the length of the corresponding work roll of the leveler and further includes the step of juxtaposing the polishers and the upper and lower work rolls of the levelers followed by the step of rotating the work rolls to polish same within the polisher pans, after extending the polishers to further contact the work rolls during the rotation of the work rolls. In at least some of these embodiments the method further includes the step of inserting the polishers into the leveler through the use of an air motor to move the polishers as a unit relative to the table support and for inserting the polishers between the upper work rolls and the lower work rolls of the leveler. In some of these embodiments also, the method further includes the step of extending the polishers through the use of an air motor and valve to inflate and adjust internal air bags within the polishing apparatus, in order to enable the polishers to come into contact with and polish the work rolls. In at least some of these embodiments, the method further includes the step of positioning the top polishers to simultaneously contact and polish all of the upper work rolls and/or positioning the bottom polishers to simultaneously contact and polish all of the lower work rolls. In yet other preferred embodiments, the method includes the step of positioning the top and bottom polishers to simultaneously contact and polish all of the upper and lower work rolls respectively.

In yet other embodiments of the invention, the method includes the further steps of retracting the top and bottom polishers of the polishing apparatus after the polishing process, as well as removing the polishing unit of the apparatus from the leveler. In some of those embodiments, the removal of the polishers is accommodated through the use of an air or electric motor to roll the polishing unit in and out of the leveler. In the preferred embodiments of the invention, the polishers are extended into contact with the work rolls while the leveler is in its open position. In some embodiments of the invention, the polishers are brought into contact with the work rolls by at least partially closing the orientation of the work rolls located on the top portion of the leveler.

In additional embodiments of the invention, the method for polishing the work rolls in a metal sheet or plate leveler through the use of a polishing apparatus comprises the steps of: configuring the leveler into a polishing position to accept the insertion of the polishing apparatus; inserting the polishing apparatus into the leveler wherein the polishing apparatus includes upper and lower polishers restrainably positioned relative to one another on a unitary platform, said polishers being capable of being simultaneously aligned with, and engaged with, respective work rolls. In these embodiments, the polishers are configured from substantially rigid concave pans having an abrasive material positioned therewithin. In this method also the polishers can be aligned, engaged with and, accordingly, polish the work roll during the rotation of the work roll. Further, in these embodiments, the polishers are configured to engage and polish substantially the entire operable length of the corresponding work roll in the leveler by lowering the upper work rolls to eventually engage the upper and lower polishers respectively, followed by the step of rotating the work rolls to simultaneously polish the work rolls during their rotation.

The feature or features of any one embodiment may be applied to yet other embodiments even though not described or illustrated, unless expressly prohibited by this disclosure or the nature of the embodiments.

Details associated with the embodiments described hereinabove and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

Figure 1:
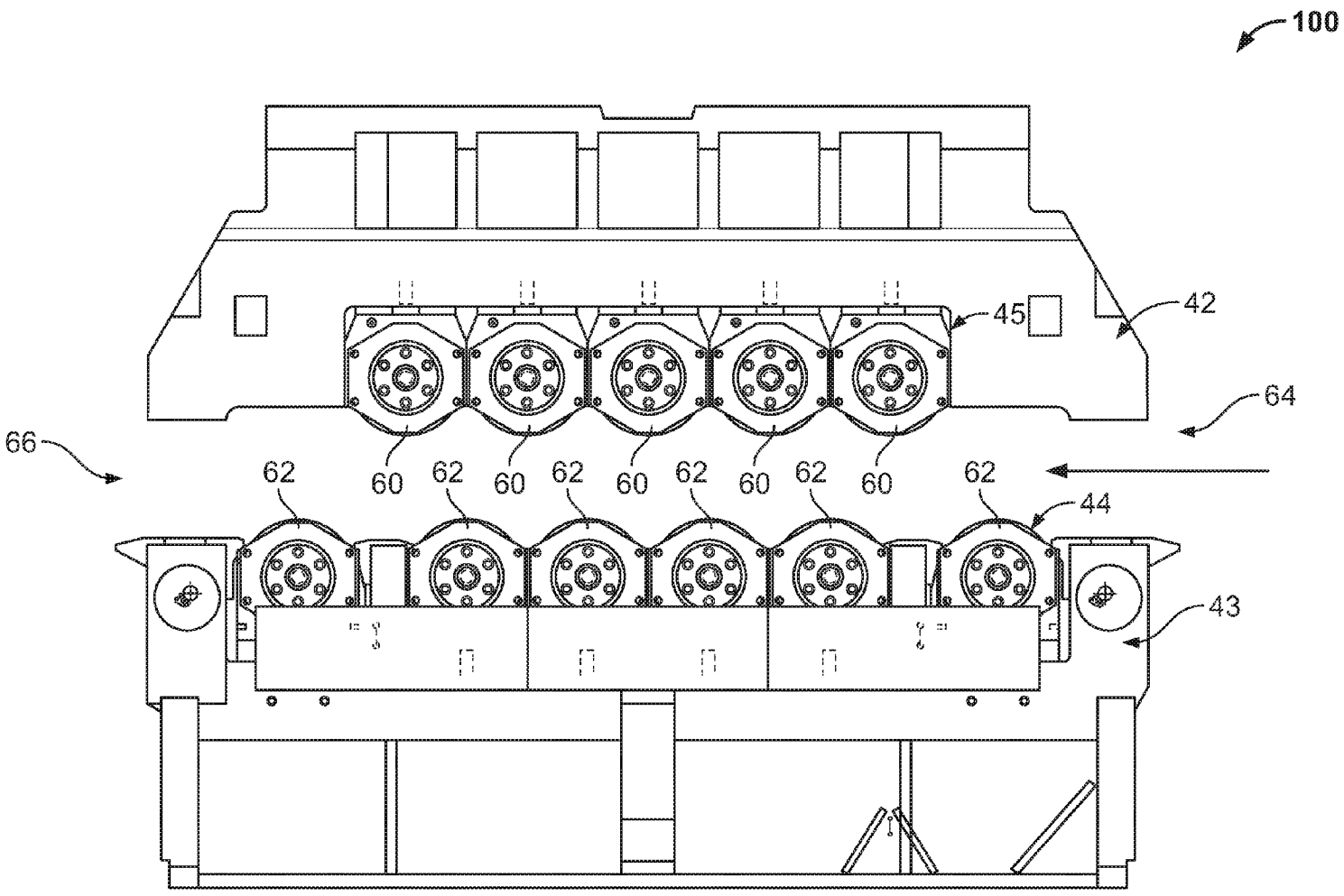
FIG. 1 shows an elevated front view of a metal sheet or plate leveler.

Generally speaking, various embodiments of the present invention provide for apparatuses and methods for safely and efficiently polishing the work rolls of a metal sheet or plate leveler for example, hot leveler 100 as shown in FIG. 1. The metal may be any metal, including but not limited to steel, aluminum or bronze. Leveler 100 is made up of top portion 42, which can be raised and lowered, and bottom portion 43, which is typically stationary.

Figure 2:
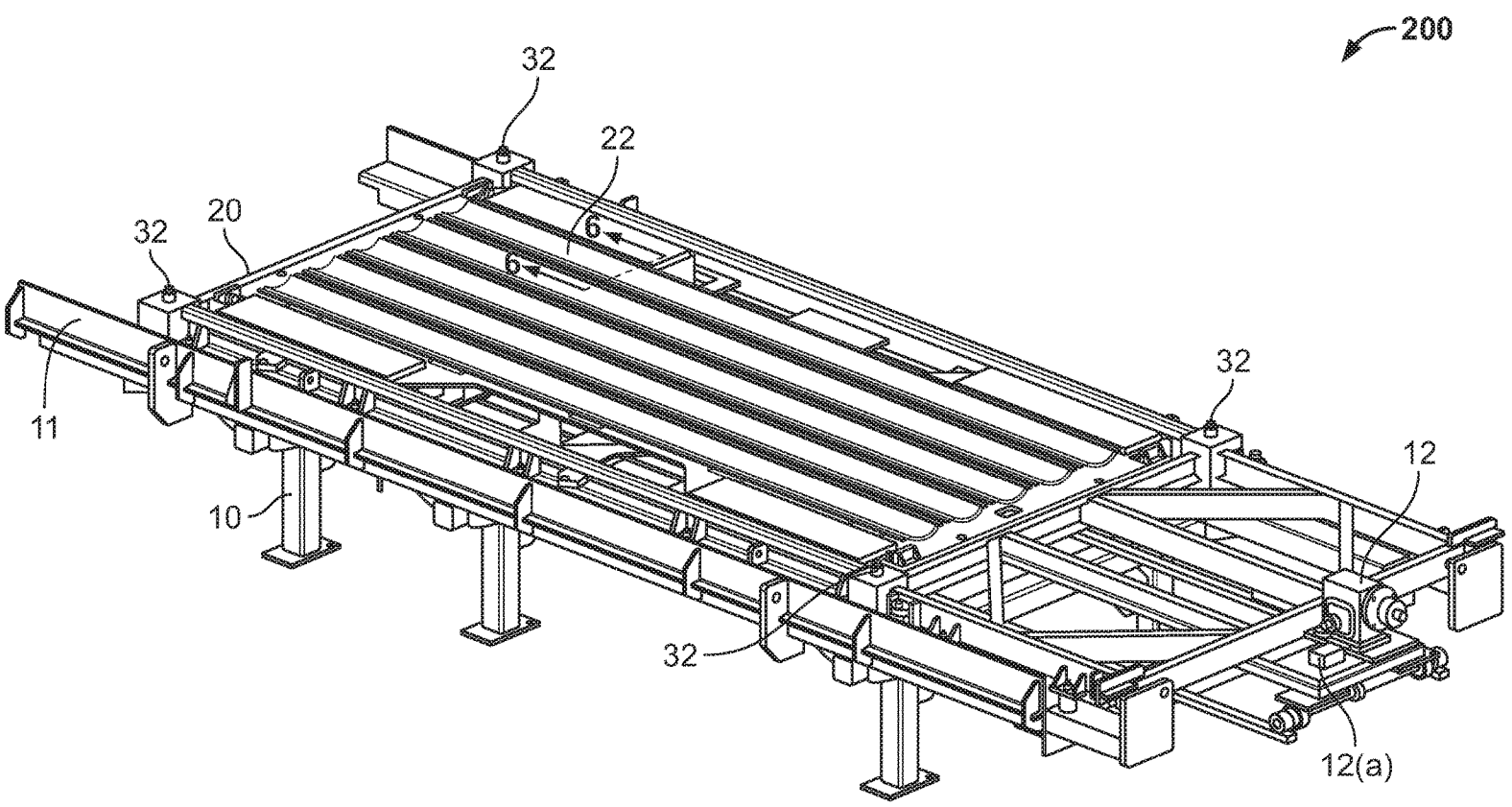
FIG. 2 shows a perspective view of one embodiment of the present apparatus for polishing a metal sheet or plate leveler, which includes upper and lower platforms for supporting a plurality of polishers, together with the concave pans of the series of upper work roll polishers, according to various embodiments of the disclosure.
Figure 3:
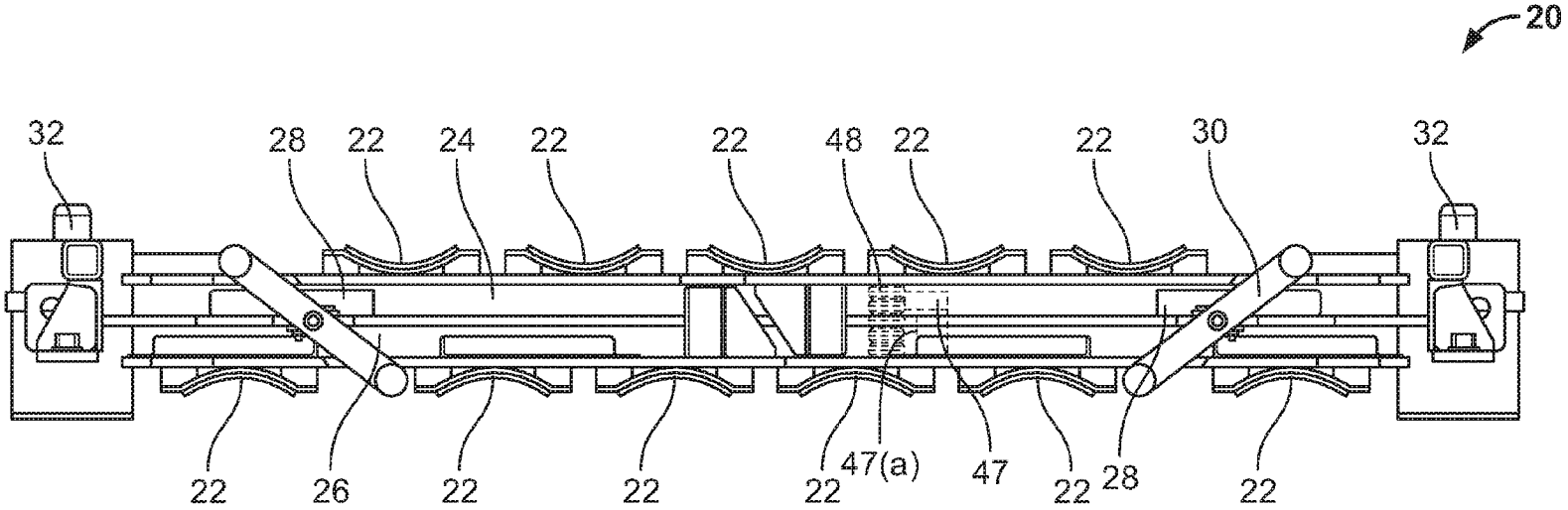
FIG. 3 shows an elevated front view of the polisher apparatus of FIG. 2, sharing both series of upper and lower polishers according to various embodiments of the disclosure.
Figure 5:
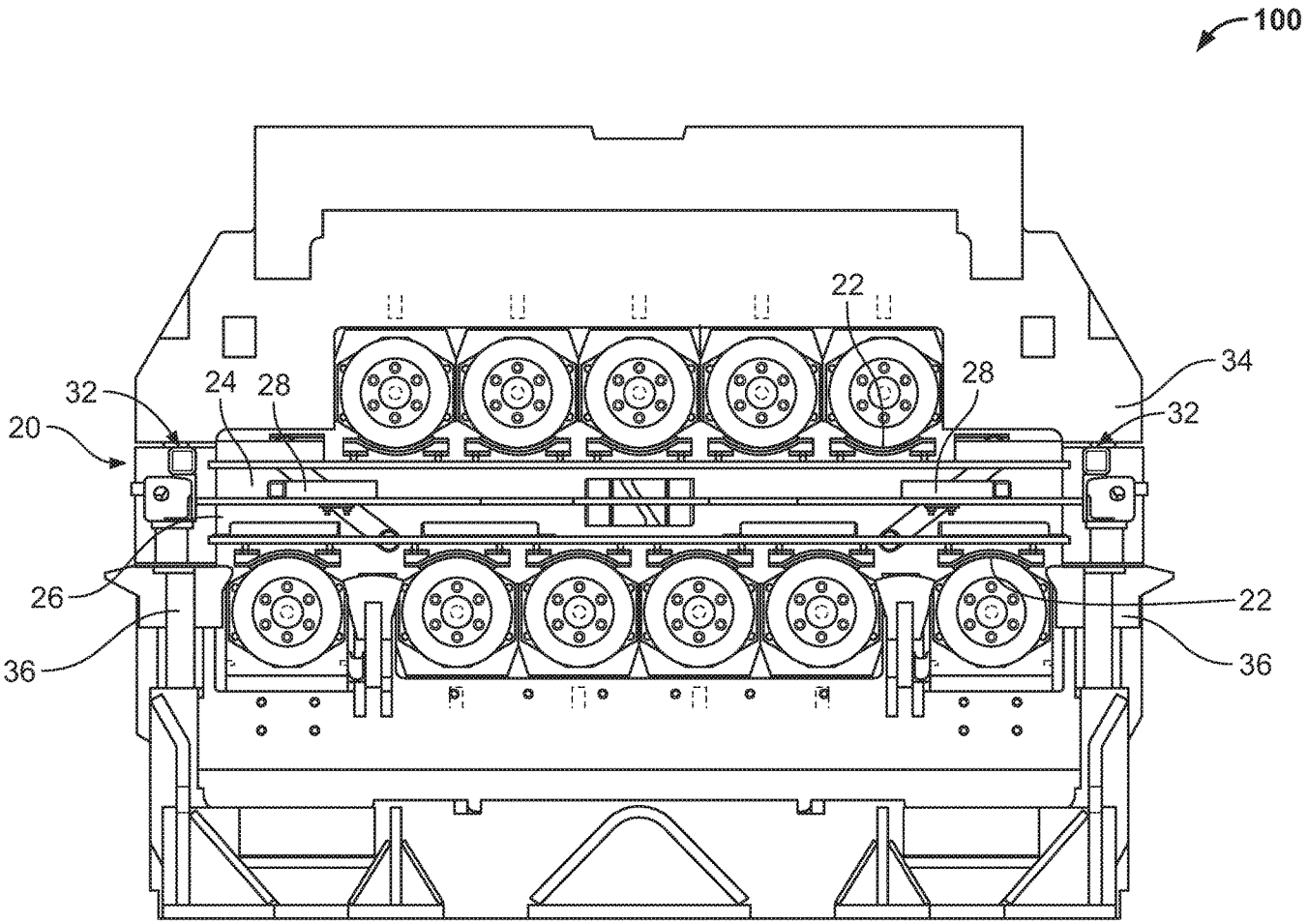
FIG. 5 shows an elevated front view of one embodiment of the polisher apparatus in its polishing position within the leveler, according to various embodiments of the disclosure.

Apparatus 200, as shown in FIG. 2, may include polishing unit 20 and stationary table support 11. Table support 11 may be positioned in front of leveler 100,) where polishing unit 20 may be moved and inserted (and/or removed) from a position between the opposing series of work rolls 45, 44 (e.g., upper work rolls 45 and lower work rolls 44) of leveler 100, from the operator side (non-driven side) of the leveler. Polishing unit 20 may include multiple polishers 22 on its top and bottom surfaces, and thus is capable of polishing a plurality of work rolls 45 of leveler 100 during the rotation of work rolls 45, while each of polishers 22 engages and polishes at least the majority of the operable length of a corresponding work roll of the leveler. Further, the polishing unit may include one or more internal expandable elements, such as air bags 28, between upper and lower platforms 24, 26 of polishing unit 20 (as shown in FIG. 3), to allow polishing unit 20 to be expanded within leveler 100, thereby causing polishers 22 (e.g., the abrasive material within the pans) to contact and polish the rotating work rolls 60, 62. In some embodiments, the polishing unit simultaneously contacts and polishes, or just polishes, all of the upper and/or lower work rolls during the polishing process, as shown in FIG. 5. After the polishing process, the expandable element may be retracted, to reorient platform 24 proximate to platform 26, to enable polishing unit 20 and, if desired, apparatus 200 in its entirety, to be removed from proximity with the leveler.

Figure 6:
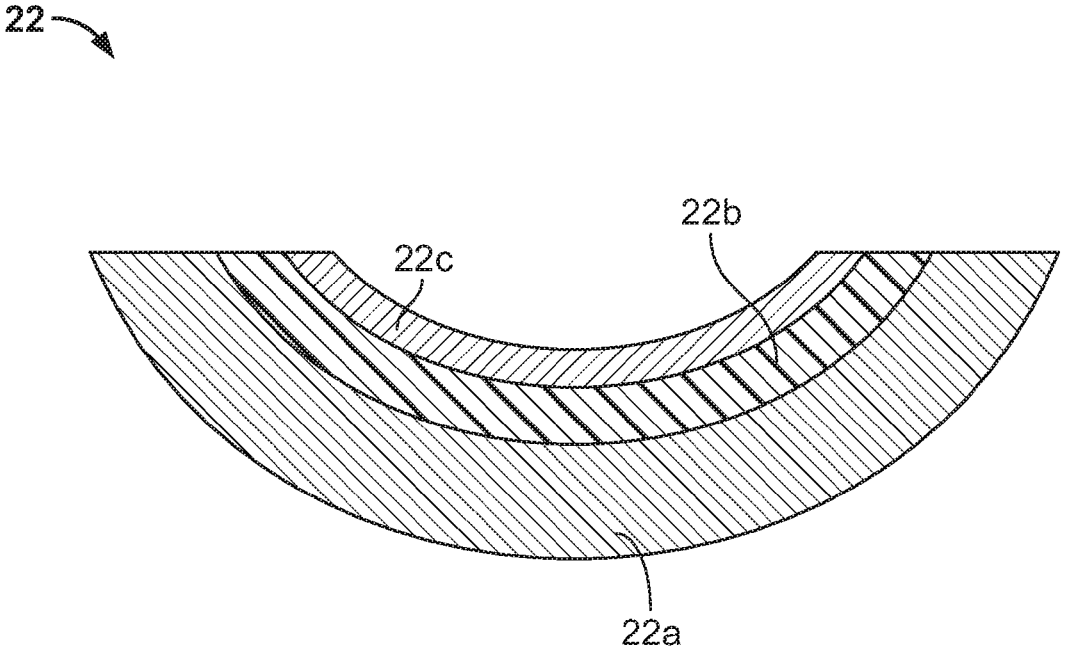
FIG. 6 is an elevated cross-sectional view of a polisher assembly taken along lines 6-6 of FIG. 2 and looking in the direction of the arrows.

FIG. 2 illustrates polishing apparatus 200 in accordance with various other embodiments of the present invention. Apparatus 200 includes apparatus table 11 with support leg 10. Stationary apparatus table 11 balances and supports polishing unit 20 movably positioned thereon, to enable polishing unit 20 to reciprocate into and out of leveler 100 while leveler 100 is in its open position. A user may operate and control the movement of polishing unit 20 relative to table 11, optionally by motor 12 (such as an air motor), with its controls and valves 12(*a*) thereby moving polishing unit 20 into and out of a leveler 100. Further, polishing unit 20 may include one or more polishers 22, on each of its top and bottom platforms 24, 26. Each polisher 22 is shaped and sized to align with, engage and receive corresponding work roll 60, 62 of leveler 100. As shown in FIG. 2, polishers 22 comprise substantially rigid concave pans 22(*a*), each supporting an abrasive surface or abrasive lining 22(*b*), or a combination of a firm rubber backing 22(*b*) and an abrasive paper 22(*c*), as shown in FIG. 6. As such, during the polishing process, multiple work rolls of the leveler may simultaneously be polished by abrasive surfaces.

FIG. 3 shows a side view of polishing unit 20, to illustrate the structures and components of this embodiment in more detail. Specifically, platforms 24 and 26 are shown in their retracted orientation position in FIG. 3. In this embodiment, upper polishers 22 on platform 24 are configured to be extended away from the lower polishers 22 on lower platform 26. The juxtapositioning of the two platforms making up polishing unit 20 enables polishing unit 20 to be inserted between the upper and lower work rolls within leveler 100; once the series of upper work rolls 45 in movable leveler top portion 42 have been retracted away from the stationary series of leveler lower work rolls 44 in stationary leveler bottom 43, as the leveler assumes its open position shown in FIG. 1.

Figure 4:
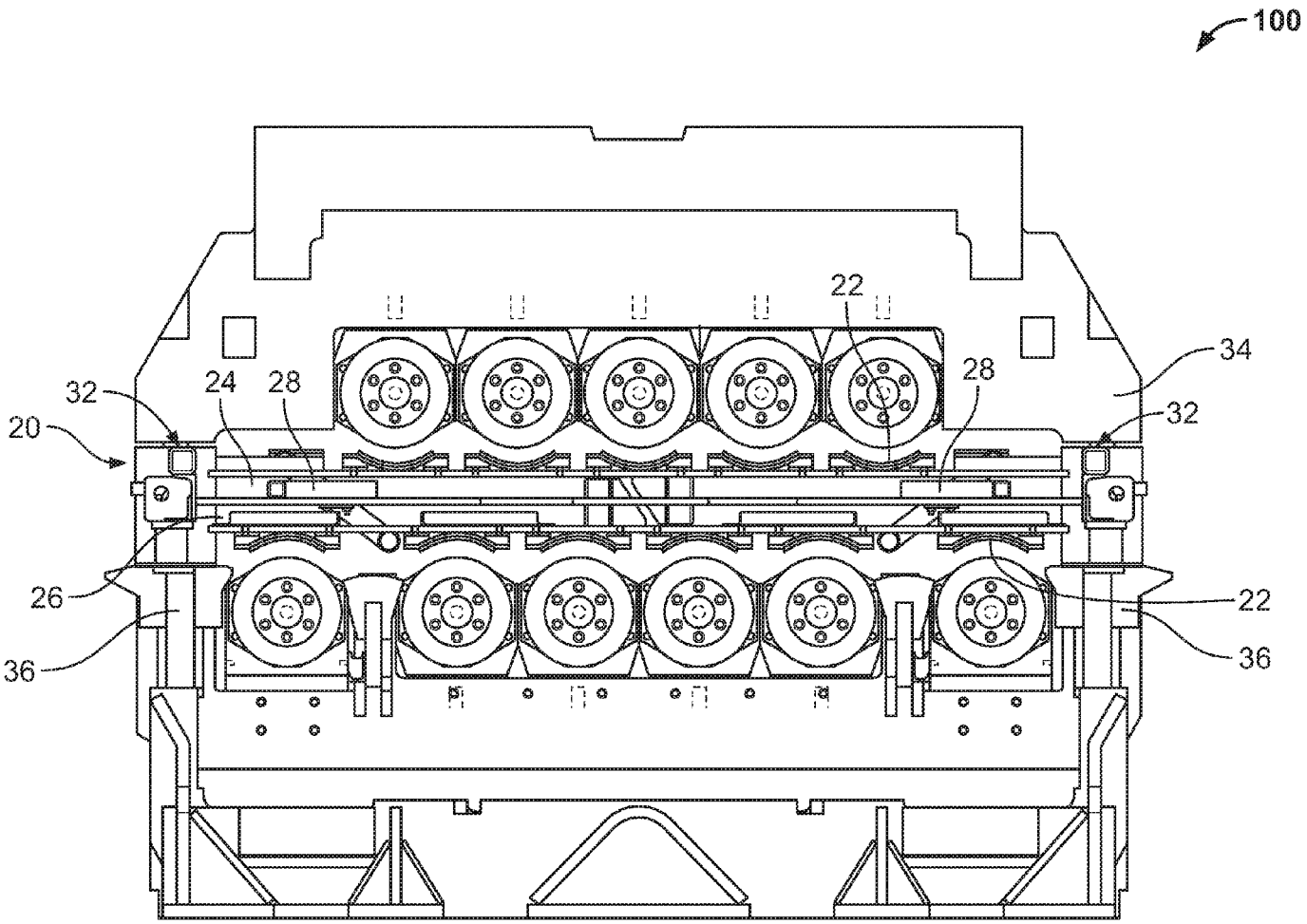
FIG. 4 shows an elevated front view of the polishing apparatus in its orientation position, enabling its insertion into an open leveler, according to various embodiments of the disclosure.

Also shown in FIG. 3 are air bags 28 for extending platform 26 away from platform 24, upon activation of the air bags, such as also by air motor 12 and air motor control 12(*a*), shown in FIG. 2, or by a separate air motor. The shape of the concave pans making up polishers 22 is shown in FIG. 3, together with the abrasive linings 22(*a*) in each such pan. A close-up of the polisher structure is shown in FIG. 6. As shown in phantom in FIG. 3, as an alternative to air motor 12, an electric motor 47, together with motor control 47(*a*), can be utilized to extend upper platform 24 apart from lower platform 26 to engage work rolls 60, 62 with respective polishers, when the work rolls are in their open position, through electric motor 47 and the rotation of motor gearing 48, also shown in phantom. Platform lock lever 30 is also shown in FIG. 3, together with polishing unit 20 locating lock pins 32—which enable the alignment of the polishers 22 with respective ones of work rolls 60, 62, through cooperation of pins 32 with apertures in top portion 42 of leveler 100. As shown in FIGS. 4 and 5, locating lock pins 32 specifically cooperate with aligned apertures in leveler top 42 to maintain the polishers in alignment with their respective work rolls, both immediately prior to and during the polishing operation.

As shown in FIG. 4, polishing unit 20 includes upper platform 24 and lower platform 26, where polishers 22 are positioned on the top surface of upper platform 24 and on the bottom surface of lower platform 26. In the illustrated embodiment, upper platform 24 includes five concave polishers, and lower platform 26 includes six concave polishers, such that each polisher 22 corresponds to one of the eleven work rolls 60, 62 of leveler 100 from FIG. 1. Polishing unit 20 may also include one or more expandable elements 28 positioned between upper portion 24 and lower portion 26. Expansion and retraction may be orchestrated by expandable air bag 28, by hydraulic or pneumatic pistons, or by electric motor 47, or the like. When apparatus 200 is in use, expandable element 28 causes polishers 22 to contact and polish rotating work rolls 60, 62. When apparatus 200 is not in use, it is desirable to retract expandable element 28, so as to bring upper platform 24 and lower platform 26 closer together. Polishing unit 20 may include rollers and levers 30 to hold the upper and lower portions together when apparatus 200 is not in use.

FIGS. 4-5 illustrate polishing unit 200 inserted in leveler 100. Polishing unit 200 is inserted from the operator side of leveler 100 (e.g., towards the longitudinal direction of the work rolls). To ensure that polishing unit 200 is securely positioned within leveler 100, especially during the polishing process, locating and locking pins 32 are utilized to locate and lock polishing unit 200 into level top 42 of frame 34 of the leveler, with the respective polishers 22 and work rolls 60, 62 aligned for engagement and polishing. Entry and exit aprons 36 are placed on the entry and exit sides of leveler 100, to allow for even elevation for insertion of polishing unit 200. As shown in FIG. 4, before the polishing process, expandable elements 28 are in their contracted state (e.g., not inflated), and upper platform 24 and lower platform 26 are locked together. In the illustrated embodiment, eleven polishers 22 are positioned proximate to each of the respective eleven work rolls 60, 62 in leveler 100. As shown in FIG. 5, during the polishing process, expandable elements 28 may be extended (e.g., inflated) and adjusted. As such, the polishers in polishing unit 200 are extended to engage and contact the upper and/or lower work rolls of leveler 100, and thus polishers 22 can polish the work rolls when the work rolls commence rotation. After the polishing process, expandable elements 28 may be retracted and polishing unit 20 may then be removed from the leveler by itself, or as part of the removal of overall apparatus 200.

FIG. 6 displays the three primary layers of an embodiment of the present polishers, such as polishers 22, namely concave pan 22(*a*), resilient liner backing 22(*b*), and abrasive material layer 22(*c*).

Figure 7:
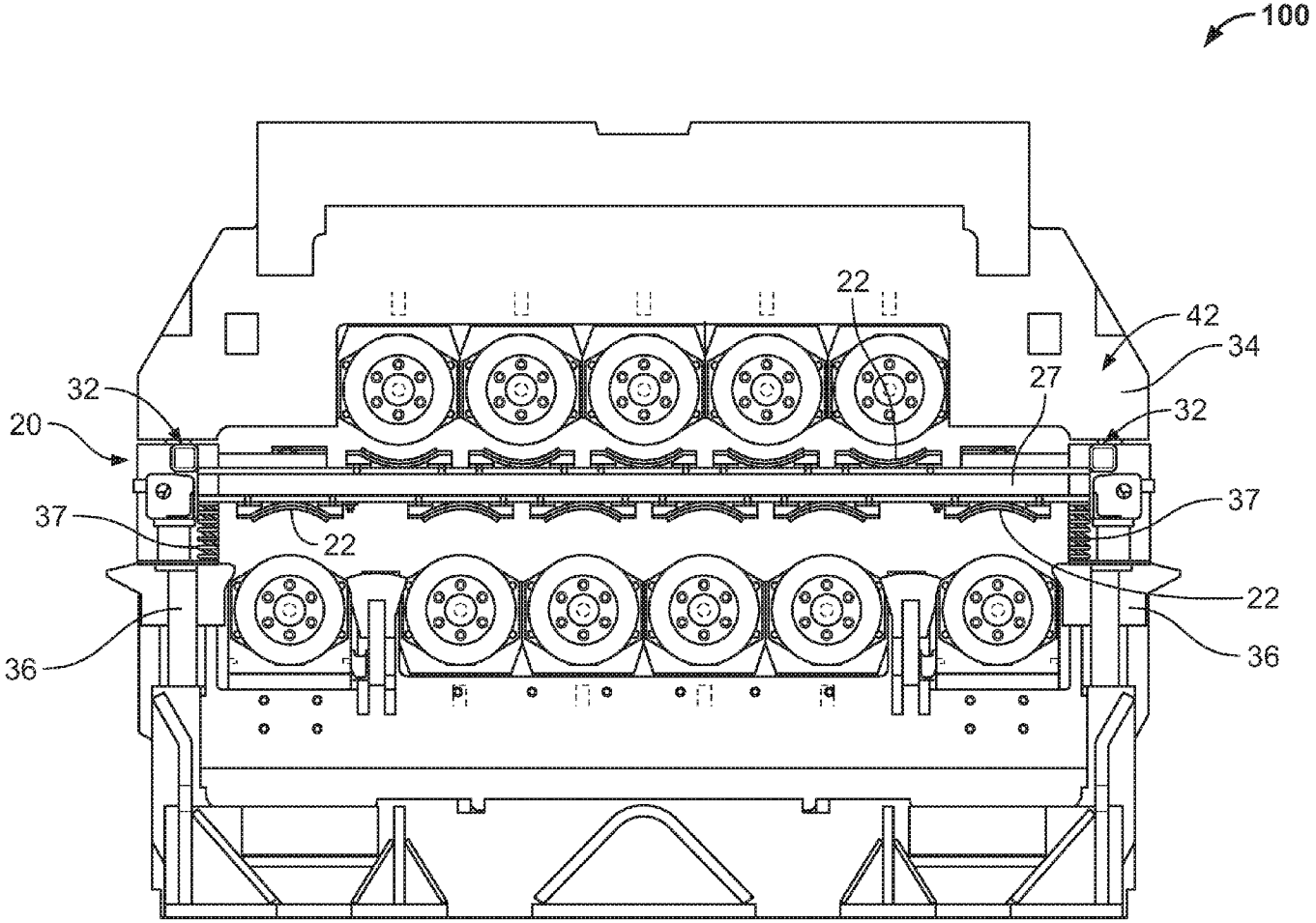
FIG. 7 is an elevated front view of another embodiment of the polisher apparatus positioned prior to engagement of its polishers with the work rolls, in which the polisher unit relies upon a single unitary platform for supporting both its upper and lower polishers, all of which polishers can be brought into contact with all the work rolls respectively, upon lowering of the top of the leveler.

In an alternative embodiment of the invention, as shown in FIG. 7, platforms 24 and 26 are integrated into one unitary platform 27, in which the upper and lower polishers 22 do not extend and retract from one another. In this embodiment, platform 27 is spring loaded relative to polishing unit 20 at spring coils 37. Engagement of polishers 22 with work rolls 60, 62 is accommodated by lowering leveler top 42 after the polisher unit has been inserted into the open leveler. In this embodiment, upper work rolls 60 in leveler top 42 engage and press upper polishers 22 on the top of platform 27, and, in turn, lower polishers 22 on the bottom of platform 27 into aligned engaged contact with lower work rolls 62 in leveler bottom 43. In this embodiment, the abrasive material 22(*c*), or resilient backing 22(*b*) within the substantially rigid tray 22(*a*) of polisher 22 are thicker or otherwise more resilient, to accommodate the force which leveler top translates downwardly, to provide a tolerable range of polisher-on-work-roll pressures.

As an exemplary operating process, a user may first check the leveler and make sure that it is prepared and ready to be polished. For instance, the user should verify that all metal sheets or plates have passed the hot leveler onto the cooling bed, and should turn off cooling water to leveler rolls. Next, the user will configure the leveler into its fully open position before inserting the polishing unit. The user can then insert or push the polishing unit into the leveler. After the polishing unit is inserted and aligned, the user can adjust the gap between the work rolls and begin rotating the work rolls at a desired speed. During the rotation of the work rolls, the user may then further enlarge and adjust the extendable element distance within the polishing unit (e.g., by a valve), so that the polishers sufficiently contact and polish the rotating work rolls under suitable contact pressure. For instance, in embodiments in which the expandable units are air bags, the user may inflate the air bags by using valve control 12(*a*) located on the operator side, while continuing to rotate the work rolls, while they engage with the polishers of the polishing unit (e.g. for about 5 minutes for each setting). During this process, the user may inspect and verify that the polishers (especially those corresponding to the entry and exit rolls) are appropriately contacting the work rolls, and adjust the pressure of the air bags according to the desired roll pressure, as well as in response to temperature and noise. After the polishing process, the user can retract the expandable element(s) of the polishing unit, while the work rolls are still rotating. Then, the user may set up the leveler in the full open position again and stop the rotation of the work rolls. Finally, the user may remove the polishing unit and/or the polishing unit and the apparatus as a whole, from out of the open leveler, and/or the vicinity of the leveler.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus for polishing the work rolls of a metal leveler, each said work roll having a work roll circumference and a work roll length, the leveler having a frame, a series of upper work rolls and a series of lower work rolls, said apparatus comprising:

one or more polishing units sized, shaped and configured to be removably inserted between the series of upper work rolls and the series of lower work rolls of the leveler, at a position under the lowest points of the series of upper work rolls and over the highest points of the series of lower work rolls, said polishing unit comprising at least one polisher configured for engaging and polishing at least one of said series of upper and lower work rolls of the leveler during the rotation of said work roll, said at least one polisher including a substantially rigid concave pan having an abrasive material positioned therewithin for exposure of said abrasive material to said respective work roll upon engagement of said polisher with said respective work roll and upon rotation of said work roll within said substantially rigid concave pan.

2. The apparatus according to claim 1 in which said at least one polisher is configured to engage and polish at least the substantial length of a corresponding one of said work rolls of the leveler as said work roll is rotated, without repositioning said polisher along the longitudinal axis of said work roll.

3. The apparatus according to claim 1 in which said at least one polishing unit comprises at least two polishers, a first polisher configured for engaging at least one work roll of the upper series of work roils and a second polisher configured for engaging at least one work roll of the lower series of work rolls said first and second polishers configured to polish said respective upper and lower work rolls simultaneously as each respective work roll rotates while in engagement with each said first and second polishers.

4. An apparatus for polishing the work rolls of a metal leveler, each said work roll having a work roll circumference and a work roll length, the leveler having a frame, a series of upper work rolls and a series of lower work rolls, said apparatus comprising:

one or more polishing units sized, shaped and configured to be removably inserted between the series of upper work rolls and the series of lower work rolls of the leveler, said polishing unit comprising at least one polisher configured for engaging and polishing at least one of said series of upper and lower work rolls of the leveler during the rotation of said work roll, said at least one polisher including a substantially rigid concave pan having an abrasive material positioned therewithin for exposure of said abrasive material to said respective work roll upon engagement of said polisher with said respective work roll and upon rotation of said work roll within said substantially rigid concave pan, said at least one polishing unit comprising a first series of polishers corresponding in number to the number of work rolls in said series of upper work rolls and a second series of polishers corresponding in number to the number of work rolls in said series of lower work rolls, said first series of polishers configured to simultaneously engage each of said work rolls in said series of upper work rolls respectively, said second series of polishers configured to simultaneously engage each of said work rolls in said series of lower work rolls respectively, all of said first and second series of polishers operably configured to polish said respective series of upper and lower work rolls as all of said work rolls rotate while engaged with said first and second series of polishers.

5. The apparatus according to claim 4, wherein all of said series of upper polishers are operably positioned on an upper platform, and all of said series of lower polishers are operably positioned on a lower platform, the polishers on said upper platform being exposed for polishing the lower circumferential surfaces of said series of upper work rolls and the polishers in said lower platform being exposed for polishing the upper circumferential surfaces of said series of lower work rolls.

6. The apparatus according to claim 5 in which the upper and lower platforms, together with said first and second series of polishers respectively, are selectively moveable relative to each other, said upper and lower platforms being capable of being repositionable from an orientation position in which the upper and lower platforms are substantially adjacent each other to permit both the alternative introduction and retraction of the apparatus into and from a position between said respective series of upper and lower work rolls, to a polishing position in which said upper and lower platforms are extended to reposition said respective first and second series of polishers into operable engagement with said series of upper and lower work rolls, to enable the polishing of said work rolls upon their simultaneous rotation.

7. The apparatus according to claim 5 in which the upper and lower platforms are integrated into a unitary platform, with the positions said first and second series of polishers respectively, substantially fixed relative to each other, each of said series of upper polishers within said unitary platform configured for engagement with said series of upper work rolls upon movement of said series of upper work rolls downwardly, toward contact between the lower circumferential portions of said upper work rolls and the abrasive material within each of the concave pans positioned within the polishers of the upper platform, said unitary platform mounted within said polishing unit being springedly lowered towards the collective position of said lower work rolls as said upper work rolls continue to be moved downwardly, each of said series of lower polishers within said lower platform configured for engagement with said series of lower work rolls upon the continued movement of said series of upper work rolls downwardly, toward establishing operable contact between the upper circumferential portions of said lower work rolls and the abrasive material within each of the concave pans positioned within the series of lower polishers oriented along the lower surface of the unitary platform.

8. The apparatus according to claim 7 in which all of the work rolls amongst the series of upper work rolls are configured to be lowered and brought into operable engagement with the polishers in the unitary platform simultaneously all of the work rolls in the series of lower work rolls being configured to be brought into subsequent operable engagement with the polishers in the unitary platform as it continues to be lowered by the upper work rolls moving downwardly by the top of the leveler.

9. The apparatus according to claim 8 in which all of the work rolls in both series of upper and lower work rolls brought into operable engagement with all of the polishers on the unitary platform can be simultaneously polished upon rotation of all of the work rolls.

10. The apparatus according to claim 1 in which said substantially rigid concave pan of said at least one polisher comprises a metallic pan assembly, said abrasive material comprising a substantially abrasive surface positioned within said pan as a lining that is positioned for engagement with said respective one of said work rolls.

11. The apparatus according to claim 10 in which the abrasive surface of the lining comprises an abrasive paper having a firm rubber backing.

12. The apparatus according to claim 1 in which said substantially rigid concave pan and abrasive material is configured to engage and conform to the circumference of said work roll.

13. The apparatus according to claim 5 in which the first and second series of polishers are configured to simultaneously polish the series of upper work roils and the series of lower work rolls respectively.

14. The apparatus according to claim 6, wherein the upper and lower platforms are repositionable to each other, between their orientation and polishing positions, through a platform translation element positioned therebetween the upper and lower platforms which enables the upper and lower platforms to be extended and retracted relative to each other.

15. The apparatus according to claim 14, in which the translation element comprises an air bag assembly positioned between the upper and lower platforms of the apparatus.

16. The apparatus according to claim 15 in which the air bag assembly includes an air motor and valve to alternatively inflate and deflate the air bag assembly to in turn extend and retract the positions of the upper and lower platforms respectively.

17. The apparatus according to claim 16 in which the upper and lower platforms are extended to enable the simultaneous polishing both said upper work rolls and said lower work rolls by said upper and lower polishers respectively.

18. The apparatus according to claim 16 in which said upper and lower platforms are retracted to enable the orientation of said apparatus into and out of the leveler, at a leveler open position between said upper and lower work rolls, with each said polisher operably aligned with a respective work roll.

19. The apparatus according to claim 1 further comprising locking pins for locating and locking the apparatus into an operable position within the frame of the leveler, for polishing the work rolls.

20. The apparatus according to claim 6 further comprising a closing element for locking the upper and lower platforms together in their orientation position while the apparatus is not in its polishing position.

21. The apparatus according to claim 20 in which the closing element comprises an assembly of rollers and levers.

22. The apparatus according to claim 5 in which each of said upper and lower platforms can reciprocate into the leveler, relative to an apparatus table support.

23. The apparatus according to claim 14 in which said translation element comprises an electric motor for alternatively extending and retracting the upper and lower platforms relative to each other.

24. The apparatus according to claim 1 in which the invention further comprises a motorized assembly for removably inserting said apparatus between said respective series of upper and lower work rolls.

25. The apparatus according to claim 14 in which said platform translation element is operably controlled by a translation control assembly.

26. The apparatus according to claim 24 in which the motorized assembly further includes an insertion control assembly.

27. A method for polishing the upper and lower work rolls of a metal leveler through the use of a polishing apparatus, the method comprising:

configuring the leveler into a polishing position to accept the insertion of the polishing apparatus;

configuring the polishing apparatus into an orientation position to enable insertion of the apparatus into the leveler, inserting the polishing apparatus into the leveler, between the upper and lower work rolls, at a position under the lowest point of the upper work roll and above the highest point of the lower work roll, wherein the polishing apparatus includes polishers configured from substantially rigid concave pans which can be simultaneously aligned for engagement with respective work rolls to simultaneously polish each of the upper and lower work rolls of the leveler during the rotation of the work rolls, wherein at least one of the polishers is configured to engage and polish substantially the operable length of the upper and lower work rolls of the leveler;

extending the upper and lower polishers to engage the upper and lower work rolls of the leveler during rotation of the work rolls; and simultaneously polishing the contacted work rolls, during the rotation of the work rolls.

28. A method for polishing the upper and lower work rolls of a metal leveler through the use of a polishing apparatus, the method comprising:

configuring the leveler in an open position;

inserting said polishing apparatus into the leveler, between the upper and lower works rolls, at a position under the lowest point of the upper work roll and above the highest point of the lower work roll, wherein the polishing apparatus includes polishers on its top and bottom surfaces for simultaneously engaging and polishing the respective work rolls of the leveler during the rotation of the work rolls, wherein at least one of the polishers includes a substantially rigid concave pan having an abrasive material therewithin, said pan being configured to engage and polish at least a majority of a length of a corresponding work roll of the leveler;

juxtaposing the polishers and the upper and lower work rolls of the leveler by extending the polishers to further contact the work rolls, during the rotation of the work rolls, rotating the work rolls to polish the work rolls within the polisher pans.

29. A method for polishing the work rolls of a metal leveler through the use of a polishing apparatus, the method comprising:

configuring the leveler in an open position;

inserting said polishing apparatus into the leveler, wherein the polishing apparatus includes polishers on its top and bottom surfaces for simultaneously engaging and polishing the respective work rolls of the leveler during the rotation of the work rolls, wherein at least one of the polishers includes a substantially rigid concave pan having an abrasive material therewithin, said pan being configured to engage and polish at least a majority of a length of a corresponding work roll of the leveler, said step of inserting the top and bottom polishers into the leveler comprises using an air motor to move the polishers relative to a table support and inserting the polishers between the upper work rolls and lower work rolls of the leveler;

juxtaposing the polishers and the upper and lower work rolls of the leveler by extending the polisher to further contact the work rolls, during the rotation of the work rolls, rotating the work rolls to polish the work rolls within the polisher pans.

30. A method for polishing the work rolls of a metal leveler through the use of a polishing apparatus, the method comprising:

configuring the leveler in an open position;

inserting said polishing apparatus into the leveler, wherein the polishing apparatus includes polishers on its top and bottom surfaces for simultaneously engaging and polishing the respective work rolls of the leveler during the rotation of the work rolls, wherein at least one of the polishers includes a substantially rigid concave pan having an abrasive material therewithin, said pan being configured to engage and polish at least a majority of a length of a corresponding work roll of the leveler;

juxtaposing the polishers and the upper and lower work rolls of the leveler by extending the polishers to further contact the work rolls, during the rotation of the work rolls, in which the step of extending the polishers comprises using an air motor and a valve to inflate and adjust internal air bags within the polishing unit, in order to cause the polishers to contact and polish the work rolls;

rotating the work rolls to polish the work rolls within the polisher pans.

31. The method according to claim 30 in which the top polishers simultaneously contact and polish all of the upper work rolls.

32. The method according to claim 30 in which the bottom polishers simultaneously contact and polish all of the lower work rolls.

33. The method according to claim 30 in which the top and bottom polishers simultaneously contact and polish all of the upper and lower work rolls, respectively.

34. The method according to claim 28 in which the invention further comprises:

retracting the top and bottom polishers of the polishing apparatus after the polishing process; and;

removing the polishing unit from the leveler.

35. The method according to claim 29 wherein removing the polishers from the leveler comprises using the air motor to roll the polishing unit out of the leveler.

36. The method according to claim 35 in which the polishers are extended into contact with the work rolls while the leveler is in the open position.

37. A method for polishing the work rolls of a metal leveler through the use of a polishing apparatus, the method comprising:

configuring the leveler in an open position;

inserting said polishing apparatus into the leveler, wherein the polishing apparatus includes polishers on its top and bottom surfaces for simultaneously engaging and polishing the respective work rolls of the leveler during the rotation of the work rolls, wherein at least one of the polishers includes a substantially rigid concave pan having an abrasive material therewithin, said pan being configured to engage and polish at least a majority of a length of a corresponding work roll of the leveler;

juxtaposing the polishers and the upper and lower work rolls of the leveler by extending the polishers to further contact the work rolls, during the rotation of the work rolls, at least partially closing the orientation of the upper and lower work rolls to further bring the polishers into contact with the work rolls;

rotating the work rolls to polish the work rolls within the polisher pans.

38. A method for polishing the work rolls of a metal leveler through the use of a polishing apparatus, comprising the steps of:

configuring the leveler into an open position to accept the insertion of the polishing apparatus, inserting the polishing apparatus into the leveler, wherein the polishing apparatus includes upper and lower polishers restrainably positioned relative to one another along both sides of a platform, said polishers being configured from substantially rigid concave pans which can be simultaneously aligned for engagement with respective work rolls containing an abrasive material, lowering the upper work roils to engage the upper polishers;

continuing to lower the upper work rolls to enable the lower polishers to engage the lower work rolls respectively; and simultaneously polishing the upper and lower work rolls during the rotation of the upper and lower work rolls.

39. An apparatus for polishing the work rolls of a metal leveler, each said work roll having a work roll circumference and a work roll length, the leveler having a frame, a series of upper work rolls and a series of lower work rolls, said apparatus comprising:

one or more polishing units integrally positioned on a unitary fixture, said fixture being sized, shaped and configured to collectively and removably position said one or more polishing units between the lowest points at the bottom of the series of upper work rolls and the highest points at the top of the series of lower work rolls of the leveler, said one or more polishing units comprising at least one polisher configured for engaging and polishing at least one of said series of upper and lower work rolls of the leveler during the rotation of said work roll, said at least one polisher including a substantially rigid concave pan having an abrasive material positioned therewithin for exposure of said abrasive material to said respective work roll upon engagement of said polisher with said respective work roll and upon rotation of said work roil within said substantially rigid concave pan.

40. The apparatus according to claim 39, in which said one or more polishing units comprise at least two polishers, at least one of which is configured for engaging and polishing at least one of each said series of upper and lower work rolls of the leveler, during the rotation of the at least one upper and one lower work roll.

* * * * *